US006428352B1

(12) United States Patent
Boyden

(10) Patent No.: US 6,428,352 B1
(45) Date of Patent: Aug. 6, 2002

(54) FASTENERLESS CIRCUIT BOARD SUPPORT

(75) Inventor: Franklin Demick Boyden, Union City, CA (US)

(73) Assignee: Silicon Graphics, Inc., Mountain View, CA (US)

( * ) Notice: Subject to any disclaimer, the term of this patent is extended or adjusted under 35 U.S.C. 154(b) by 0 days.

(21) Appl. No.: 09/608,981

(22) Filed: Jun. 30, 2000

(51) Int. Cl.[7] ..... H01R 13/74
(52) U.S. Cl. ..... 439/545
(58) Field of Search ..... 439/544, 545, 439/557, 549, 574, 575, 328, 567, 76.1, 59

(56) References Cited

U.S. PATENT DOCUMENTS 5,112,242 A * 5/1992 Choy et al. ..... 439/328
5,295,852 A * 3/1994 Renn et al. ..... 439/328
5,417,580 A * 5/1995 Tsai ..... 439/328

* cited by examiner

*Primary Examiner*—Tho D. Ta
(74) *Attorney, Agent, or Firm*—Schwegman, Lundberg, Woessner & Kluth, P.A.

(57) ABSTRACT

A circuit board support operable with boards requiring a horizontal motion for engagement of connectors. The support can be exchanged for a traditional standoff and screw combination without modification of the board or supporting structure.

23 Claims, 10 Drawing Sheets

FASTENERLESS CIRCUIT BOARD SUPPORT

TECHNICAL FIELD OF THE INVENTION

The present invention relates generally to the field of circuit board mounting, and, in particular, to fastenerless circuit board support systems.

BACKGROUND

Circuit board design involves not only electrical considerations but also numerous mechanical considerations. One important mechanical consideration is the provision of an adequate board mounting system. Depending upon the design objective, some board supports may advantageously be electrically connected to a supporting structure, and some board supports be insulated. Modifications after fabrication of the board and the supporting structure are often prohibitively expensive. When using mounting elements having threaded fasteners, such a change is often labor intensive since later changes require removal of the circuit board, replacement of the mounting elements and reinstallation of the board. In addition, mounting system modifications often entail altering the circuit board and the support structure.

What is needed in the art is an inexpensive mounting system allowing simplified modifications and requiring no threaded fasteners.

SUMMARY

The above mentioned problems associated with mounting systems, and other problems, are addressed by the present invention and will be understood by reading and studying the following specification.

In particular, an illustrative embodiment of the present invention includes a device comprising a base, a first rigid tab, a flexible tab, a pedestal and a board hook. The base includes a planer surface lying in a plane substantially parallel to the plane of a support structure. The base includes a longitudinal axis with a first end and a second end. The first rigid tab includes a first standoff affixed to the base and a first catch affixed to the standoff The first catch engages a first edge of the support structure upon movement of the device, relative to the support structure, in a direction towards the first end. The flexible tab extends towards the second end and has flexibility to allow deflection in a direction normal to the planer surface. The flexible tab includes a portion that intersects the plane of the planer surface. The pedestal is affixed normal to the base and extends in a direction opposite that of the first rigid tab. The pedestal includes a board support surface substantially parallel to the plane of the planer surface. The board hook is affixed to the pedestal and engages a first edge of the board upon movement of the board, relative to the device, in a direction towards the first end.

In one embodiment, the first rigid tab and the flexible tab lie along the longitudinal axis. In one embodiment, the board includes an electrical connector adapted to mate with a matching connector upon relative movement of the electrical connector and the matching connector over a distance having a predetermined length. The matching connector is coupled to the support structure, and the board hook has a slot having a length greater than the predetermined length. In one embodiment, the board support surface is insulated from the base. In one embodiment, the device includes insulative material. In one embodiment, the device is fabricated of insulative material. In one embodiment, the rigid tab standoff and the hook are aligned on an axis normal to the planer surface of the base. In one embodiment, the flexible tab is adapted to resist forces applied in directions lying in the plane of the planer surface. In one embodiment, present subject matter provides a second rigid tab including a second standoff affixed to the base and a second catch affixed to the second standoff. The second catch engages a second edge of the support structure upon movement of the device, relative to the support structure, in a direction towards the first end. In one embodiment, the second rigid tab lies on the longitudinal axis.

In an alternative embodiment, the present subject matter provides a method for mounting a circuit board, the method comprising providing a support structure, providing a fastener, engaging the fastener, deflecting a flexible tab of the fastener, engaging the flexible tab of the fastener, positioning a circuit board and displacing the circuit board to engage the fastener. The support structure has first edge and a second edge. Engaging the fastener includes engaging with the first edge of the support structure. Engaging the flexible tab of the fastener includes engaging with the second edge of the support structure.

In one embodiment, providing a support structure with a first edge and a second edge includes providing a support structure with a third edge, and the method further comprises engaging the fastener with the third edge of the support structure. In one embodiment, displacing the circuit board to engage the fastener includes engaging an electrical connector.

DETAILED DESCRIPTION

The following detailed description refers to the accompanying drawings which form a part of the specification. The drawings show, and the detailed description describes, by way of illustration specific illustrative embodiments in which the invention may be practiced. These embodiments are described in sufficient detail to enable those skilled in the art to practice the invention. Other embodiments may be used and mechanical and electrical changes may be made without departing from the scope of the present invention. The following detailed description is, therefore, not to be taken in a limiting sense. Like reference numbers refer to similar items in all the figures.

Figure 1A:
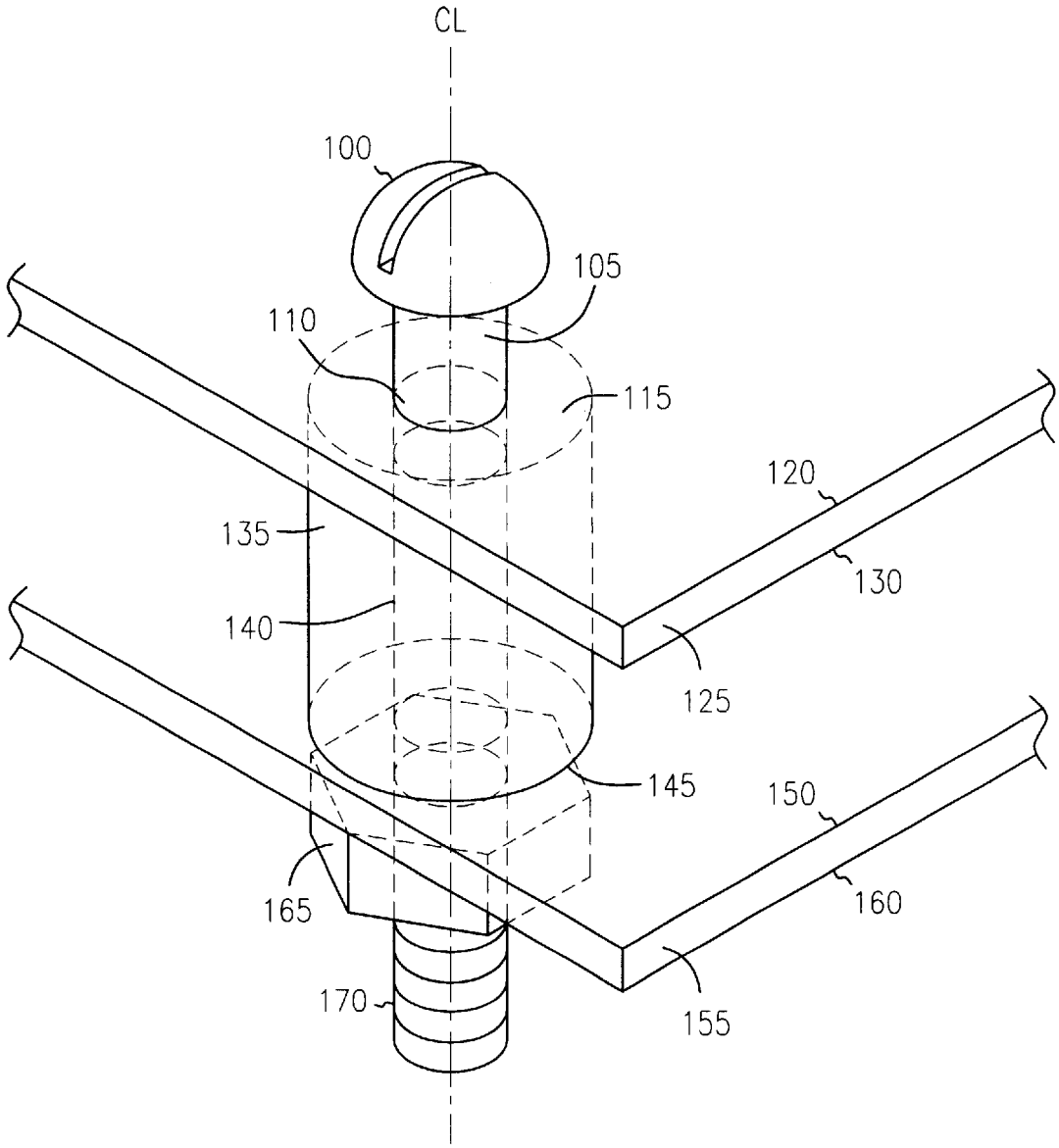
FIG. 1A illustrates a view of a screw and standoff combination.

FIG. 1A illustrates a screw and standoff assembly for mounting a circuit board relative to a support structure. Screw 105 passes through hole 110 in circuit board 125, standoff 135, support structure 155 and is threaded on nut 165. Screw head 100 is in contact with the top surface 120 of board 125. Upper end 115 of standoff 135 is in contact with the lower surface 130 of board 125. Bore 140 in standoff 135 provides clearance for the shank of screw 105. Lower end 145 of standoff 135 is in contact with the upper surface 150 of support structure 155. Nut 165 is in contact with lower surface 160 of support structure 155. Threads 170 of screw 105 secure the assembly.

Installation or removal of the standoff in FIG. 1A requires access to both nut 165 and screw head 100. In addition, alignment of standoff 135 with board 125 and structure 155 must be maintained during the installation process.

In cases requiring the board to be insulated from the support structure, insulative sleeves, washers, or fasteners may be used. In cases requiring the board to be electrically coupled to the support structure via the mounting system, conductive standoffs, conductive fasteners and other techniques may be used. Converting an insulated mount to a conductive mount, or visa versa, entails modification of the board or additional or substituted fastener systems.

Figure 1B:
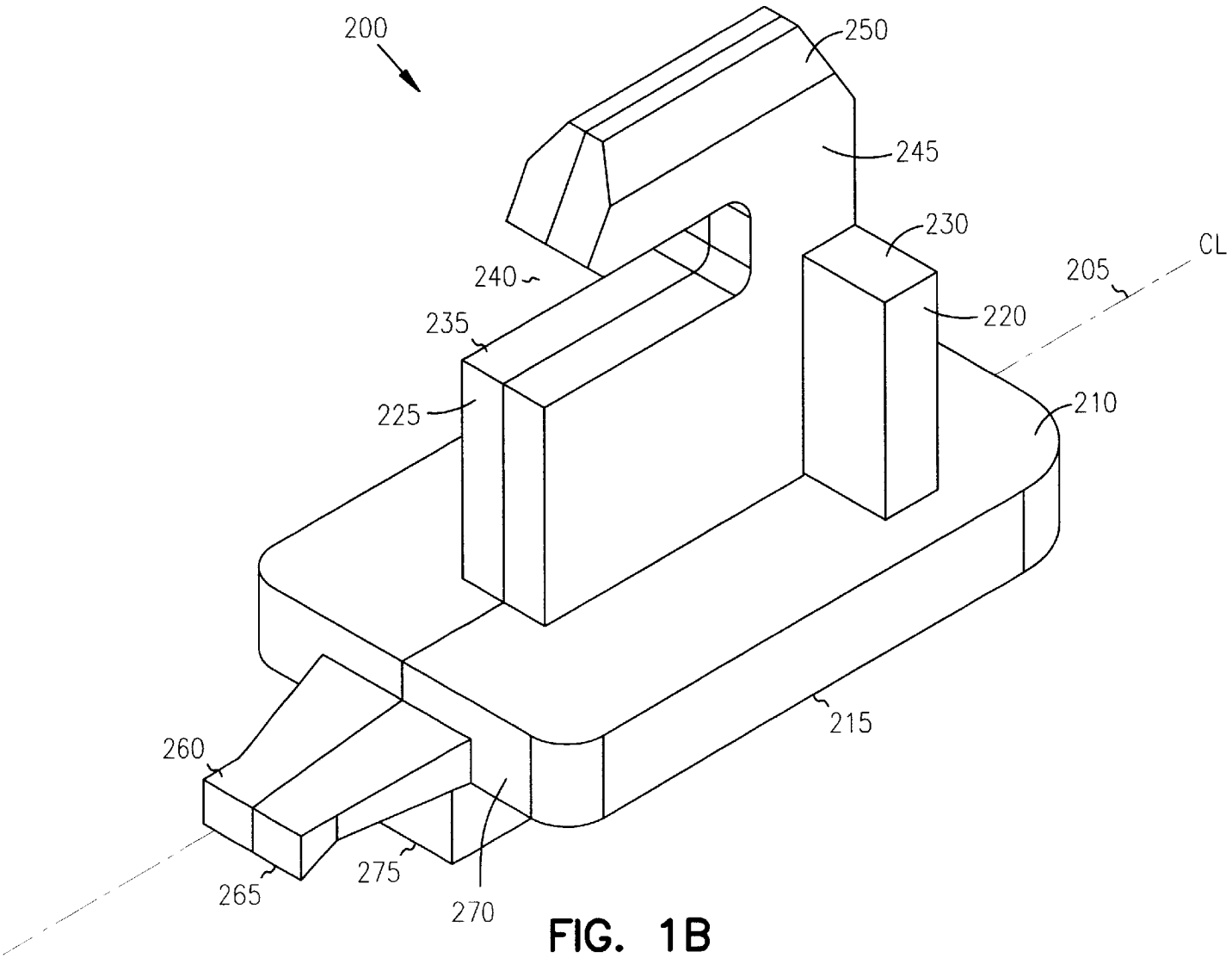
FIG. 1B illustrates an isometric view of the present system.

FIG. 1B illustrates one embodiment of device 200 of the present system. A center line, extending along the longitudinal axis, is marked 205 in the figure. Base 210 is coupled to pedestal 225 and pedestal 220. One portion of pedestal 220 is visible in FIG. 1B and a second portion of pedestal 220 is hidden from view. Board stop 235 and board stop 230 are visible on the upper surface of pedestal 225 and pedestal 220, respectively. Slot 240 is aligned horizontally and defined by the board stop 235 and hook 245. In the embodiment shown, hook 245 is affixed to a section of pedestal 225 and 220. Chamfer 250 is visible on the sides of hook 245.

Base 210 includes a lower surface 215. In the embodiment shown, lower surface 215 lies in a plane substantially orthogonal to pedestal 225 and pedestal 220. A first end of flexible tab 260 is coupled to base 210 at surface 270. End 265 of flexible tab 260 engages the support structure, as described subsequently.

Figure 2B:
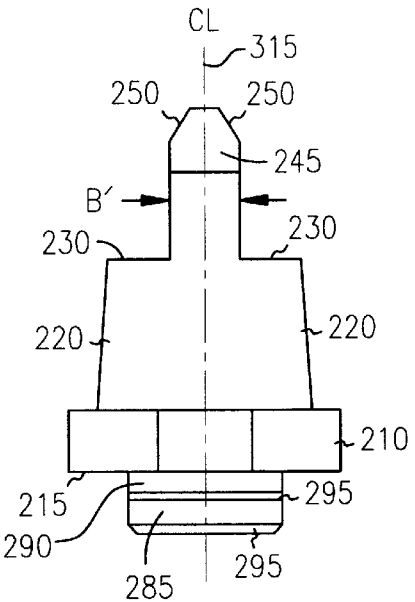
FIGS. 2A, 2B and 2C illustrate three views of the system of FIG. 1B.
Figure 2A:
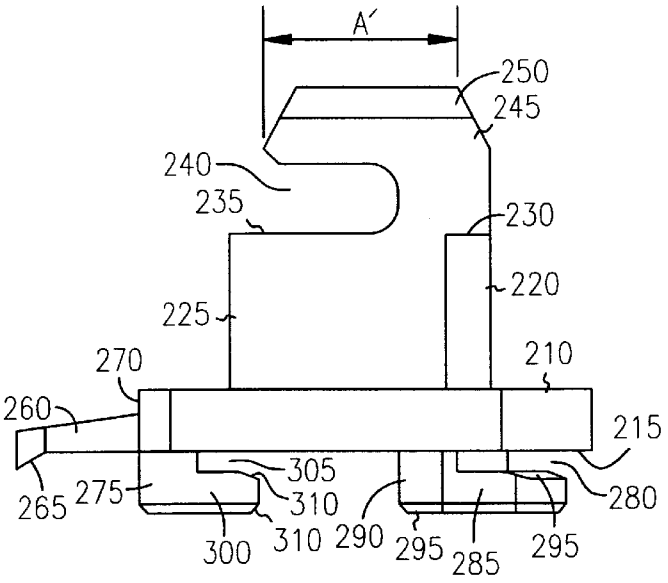

FIG. 2A illustrates a side elevation view of one embodiment of device 200. The alignment of base 210 relative to other elements is visible in the figure. For example, horizontal slot 240 is seen to be substantially parallel with the plane of lower surface 215 of base 210. Beveled edge 250 is visible on hook 245. In addition, board stop 230 and board stop 235 are also substantially parallel with surface 215. In the embodiment shown, flexible tab 260 extends substantially parallel with surface 215. End 265 intersects with, and descends below, the extension of the plane of surface 215. Flexible tab 260 tolerates slight deflections in directions normal to the plane surface 215. In particular, flexible tab 260 can be deflected, without permanent deformation, such that end 265 no longer intersects with the extension of plane surface 215. Upon removal of external forces acting on device 200, flexible tab 260 returns to a position wherein the end 265 is below the extension of plane surface 215.

A first rigid tab extends downward from surface 215 of one end of base 210. The first rigid tab includes standoff 290 and catch 285. Standoff 290 and catch 285 form throat 280. Throat 280 is defined by standoff 290, catch 285 and base 210. Selected edges of catch 285 are beveled and herein marked 295.

A second rigid tab extends downward from surface 215 of a second end of base 210. The second tab includes standoff 275 and catch 300. Standoff 275 and catch 300 form throat 305. Throat 305 is defined by standoff 275, catch 300 and base 210. Selected edges of catch 300 are beveled and herein marked 310.

FIG. 2B illustrates an end view of one embodiment of device 200. Lateral axis 315 is visible in the figure. Base 210 is substantially orthogonal to lateral axis 315. Pedestal 220 and board stop 230 are also visible in the figure.

Figure 2C:
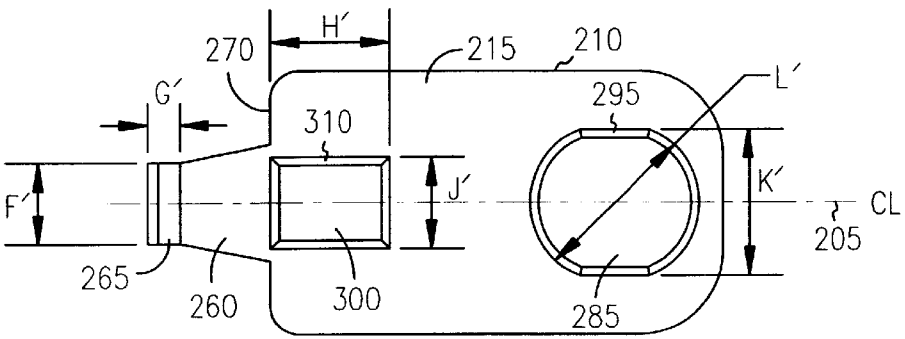

FIG. 2C illustrates a bottom view of one embodiment of device 200. Longitudinal axis 205 is visible in the figure. In the embodiment shown, the substantially linear alignment of end 265, catch 300 and catch 285 is visible. Edge chamfers 310 and 295, of catch 300 and 285 are also visible in the figure. Dimension L' denotes the overall diameter of catch 285.

In the embodiment shown, catch 300 is substantially rectangular in shape. Other geometric shapes are also contemplated, including but not limited to, circular, semicircular, oblong, or triangular.

In the embodiment shown, catch 285 is substantially circular in shape with flat sides aligned with the longitudinal axis. The diameter of the circular portion is denoted by letter L'. Other geometric shapes are also contemplated, including but not limited to, rectangular, oblong, or triangular.

In the embodiment shown, flexible tab 260 has rectangular cross-section and angled sides. Other tab shapes are also contemplated, for example, in one embodiment, 260 is a linear rod member.

Figure 3A:
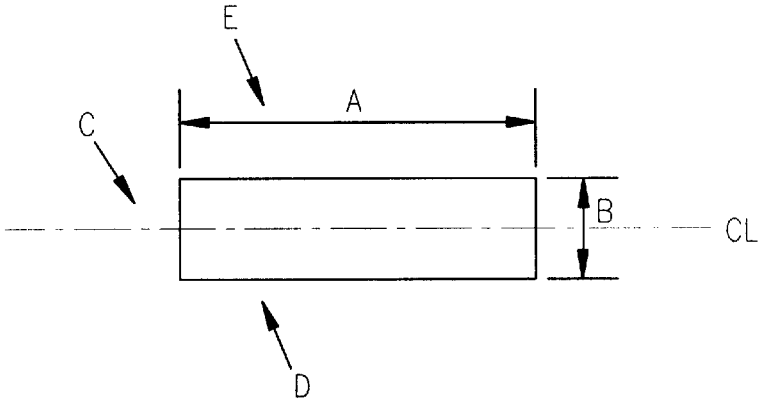
FIGS. 3A and 3B illustrate views of the circuit board hole pattern and support structure hole pattern, respectively, for one embodiment of the present system.

FIG. 3A illustrates the hole pattern for a circuit board suitable for use with one embodiment of device 200. The pattern shown in the figure is viewed from above, meaning that device 200 is positioned below the image and hook 245 extends upward through the circuit board. The geometric shapes in the figure represent openings in the surface of the circuit board.

Dimension A of FIG. 3A signifies the length of the rectangular opening in the circuit board. The rectangular opening accepts hook 245 of device 200. Dimension A of FIG. 3A is at least large enough to accept the overall length of hook 245, as denoted by dimension A' of FIG. 2A. Dimension B of FIG. 3A signifies the width of the rectangular opening and is at least large enough to accept the width of hook 245, as denoted by dimension B' of FIG. 2B. The rectangular dimensions of the opening in the circuit board may deviate from those explained herein. When the board is assembled with device 200, hook 245 captivates the board in the area denoted by the head end of arrow C of FIG. 3A. In addition, the lower surface of the circuit board is supported by board stop 230 (in the area denoted generally by arrow E and arrow D) and board stop 235 (in the area denoted generally by arrow C).

Figure 3B:
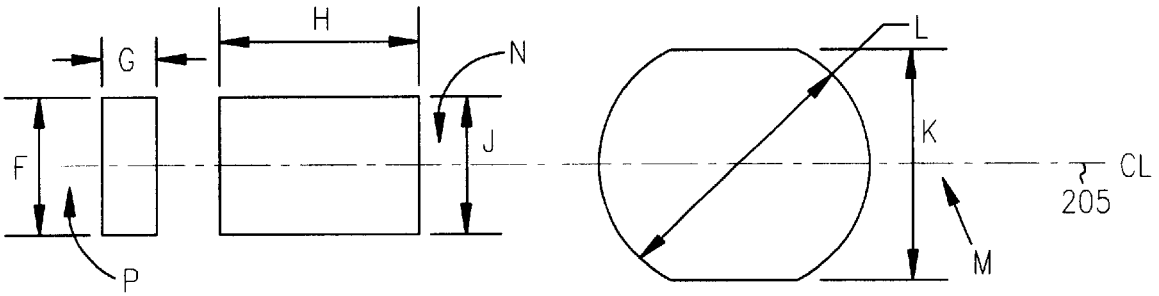

FIG. 3B illustrates the hole pattern for a support structure suitable for use with one embodiment of device 200. The pattern shown in the figure is viewed from above, meaning that device 200 is positioned from above the image and catches 300 and 285 extend downward through the support structure. The geometric shapes in the figure represent openings in the surface of the support structure. It will be noted that in the embodiment shown, the hole pattern in the support structure lies along the longitudinal axis 205.

Dimensions F and G of FIG. 3B signify the width and length, respectively, for end 265 of flexible catch 260. Dimensions F and G of FIG. 3B must be at least as large as dimensions F' and G' of FIG. 2C. Dimensions J and H of FIG. 3B signify the width and length, respectively, for catch 300 of device 200. Dimensions J and H of FIG. 3B must be at least as large as dimensions J' and H' of FIG. 2C. Dimensions K and L of FIG. 3B signify the width and diameter, respectively, for catch 285 of device 200. Dimensions K and L of FIG. 3B must be at least as large as dimensions K' and L' of FIG. 2C. The dimensions outlined in this paragraph are to be considered minimum dimensions for the hole pattern. The dimensions in the support structure may deviate from those explained herein.

In one embodiment, when device 200 is assembled with the support structure, catch 285 and catch 300 captivate device 200 in the area denoted by the head end of arrows M and N, respectively, of FIG. 3A. In addition, flexible tab 260 relies upon strength in the area of arrow P to resist movement tending to remove device 200 from the support structure. Planer surface 215 also is in contact with the support structure in the region surrounding the openings shown in FIG. 3B.

Variations in the hole template and patterns are possible. For example, in FIG. 3C, the support structure may be fabricated with two openings rather than the three shown. In one embodiment, the web between the opening having dimensions F×G and the opening having dimensions J×H is eliminated to create a single large opening.

Figure 4:
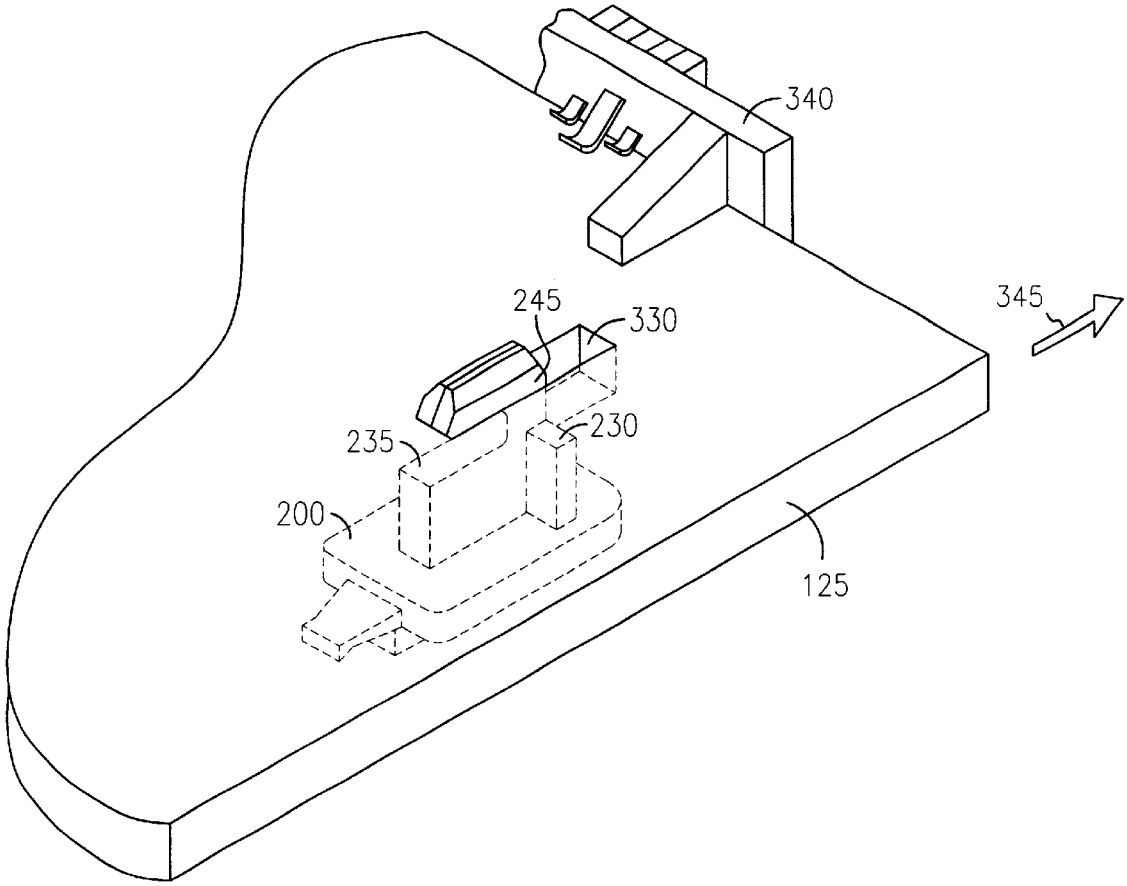
FIG. 4 illustrates a circuit board with one embodiment of the present subject matter.

In FIG. 4, circuit board 125 is shown with device 200. Circuit board 125 includes opening 330. In the embodiment shown, opening 330 is of rectangular shape and adapted to receive hook 245. Hidden lines beneath the board identify various features of device 200. For example, board stop 230 and board stop 235 are illustrated.

In FIG. 4, one end of circuit board 125 is coupled to an edge connector 340. In the embodiment shown, the edge connector is mounted on an edge substantially perpendicular to longitudinal axis 205 of device 200. Other types of connectors, such as a surface connector, and different placement of a connector, are also contemplated.

In one embodiment, circuit board 125 and device 200 are assembled by moving circuit board 125 in the direction indicated by arrow 345. Arrow 345 also corresponds with the direction of movement for mating electrical connector 340 to a matching connector. The length of the throat of device 200 is longer than the sliding distance required to mate the electrical connector. This arrangement assures that full electrical connection is established without limitation by device 200.

Figure 5:
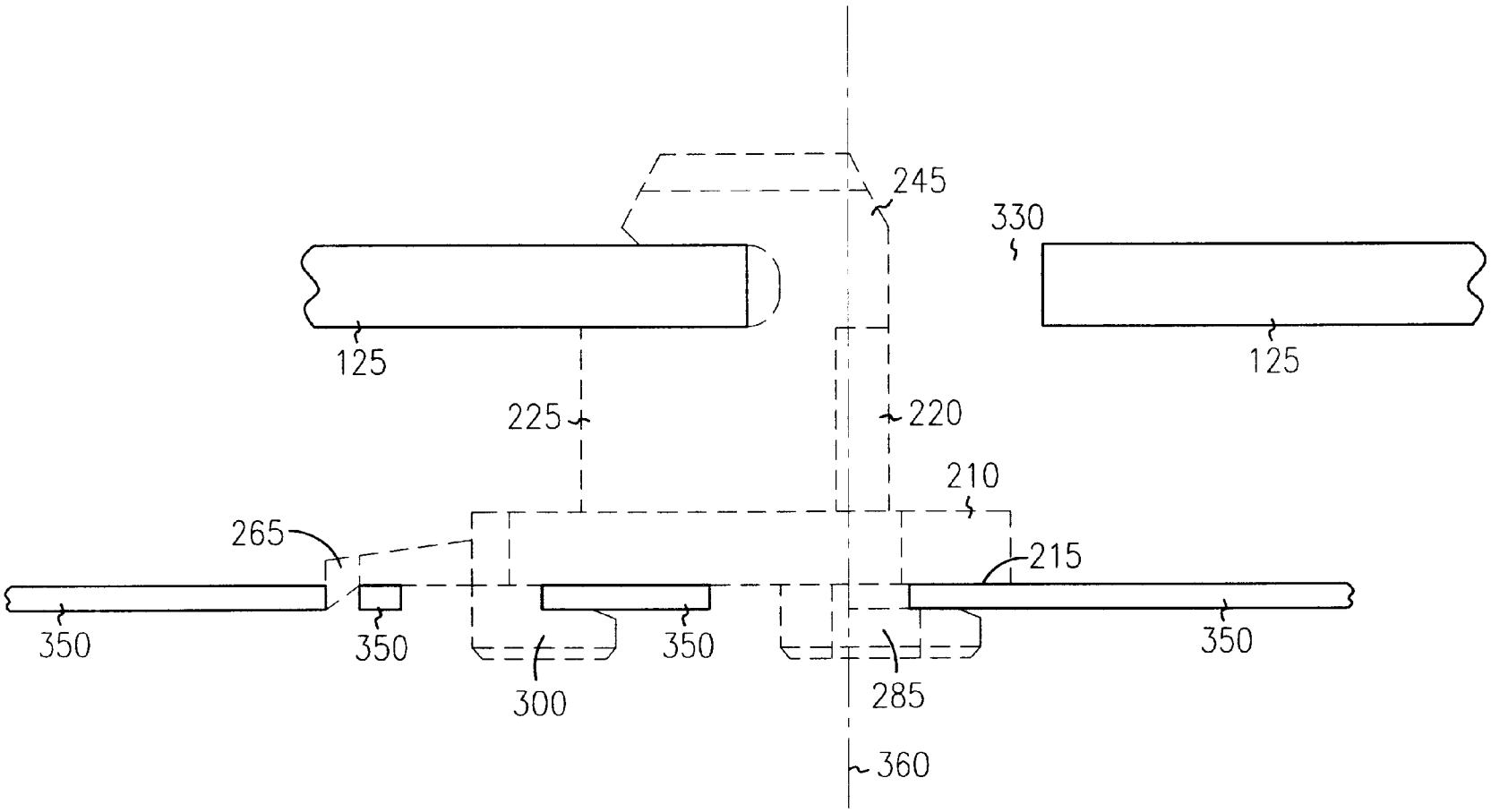
FIG. 5 illustrates a side view of one embodiment of the present system with a circuit board and supporting structure.

FIG. 5 illustrates a view of an embodiment of the present mounting system. In the figure, device 200 is shown in dashed lines, having been cut on the center line shown in FIG. 2B, marked 315. In addition, an edge view of circuit board 125 and an edge view of support structure 350 is illustrated. Device 200 is shown installed on support structure 350 and circuit board 125 is installed on device 200. As previously discussed, the throat area formed by hook 245 and pedestal 225 engages an edge of board 125. Opening 330 provides clearance to receive hook 245. Also in the embodiment shown, planer surface 215 lies along the upper surface of support structure 350. Flexible tab end 265 extends below the planer surface. During installation of device 200 onto support structure 350, end 265 is deflected in an upward direction. Upon engagement of catch 300 and catch 285 on the edges of corresponding openings in support structure 350, end 265 snaps into the opening in structure 350. In the embodiment shown, end 265 has an angled portion that engages an opening in structure 350. In various embodiments, end 265 has a radius portion or a straight portion.

FIG. 5 also indicates alignment of the various openings in one embodiment of the present mounting system. Line 360 extends through opening 330 in circuit board 125 as well as an opening in support structure 350. One of skill in the art will recognize that a standoff and screw combination can be inserted in the area denoted by line 360, in lieu of device 200. A standoff and screw combination may be used in applications requiring a mounting having threaded clamping action. In addition, a standoff and screw combination may be used in applications requiring a conductive or insulative mounting.

Figure 6B:
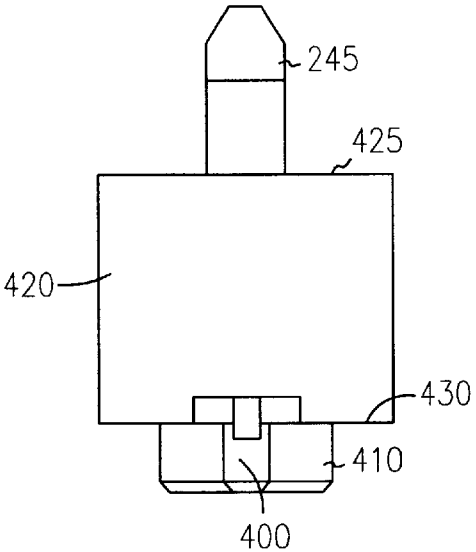
FIGS. 6A, 6B, 6C and 6D illustrate views of one embodiment of the present system.
Figure 6A:
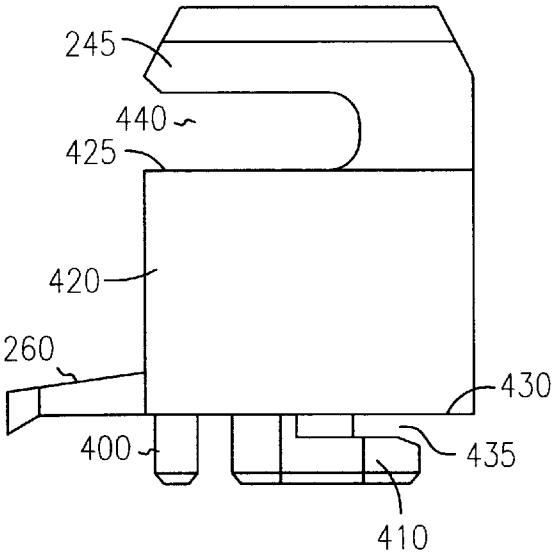
Figure 6C:
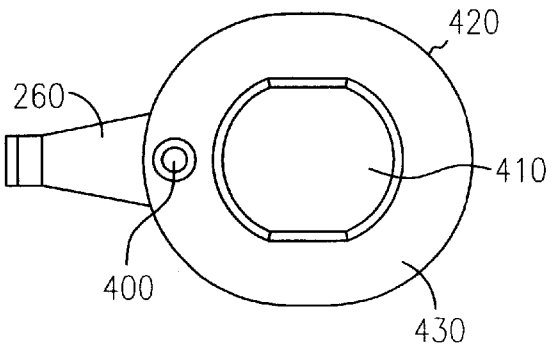
Figure 6D:
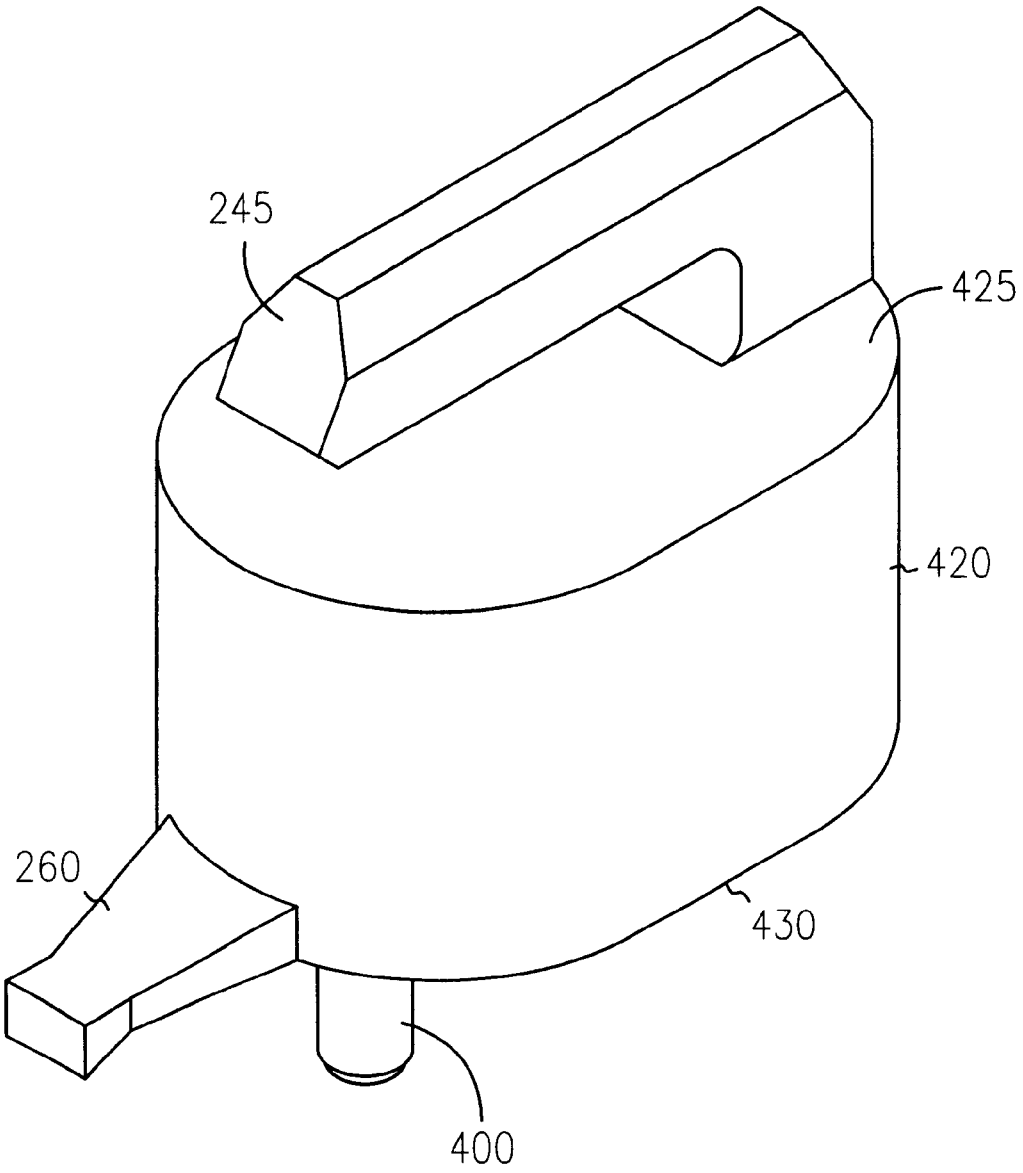

FIGS. 6A, 6B and 6C illustrate another embodiment of the present subject matter. FIG. 6D illustrates an isometric view of the embodiment of FIGS. 6A, 6B and 6C. The embodiment shown includes hook 245 and flexible tab 260. Pedestal 420 is of circular cross section and has board stop 425 and planer surface 430. Catch 410 extends below planer surface 430 and has throat 435 directed in a direction opposite that of throat 440 defined by hook 245. The vertical alignment of the opening that receives catch 410 (in support structure 350) and the opening that receives hook 245 (in circuit board 125) enables replacement of device 200 with a screw and standoff combination. Proximate to flexible tab 260 is alignment pin 400. Alignment pin 400, in the embodiment shown, has a round cross section, however other shapes are also contemplated. In addition, alignment pin 400 may be located in another position on planer surface 430. For example, pin 400 may be located opposite flexible tab 260.

Figure 7:
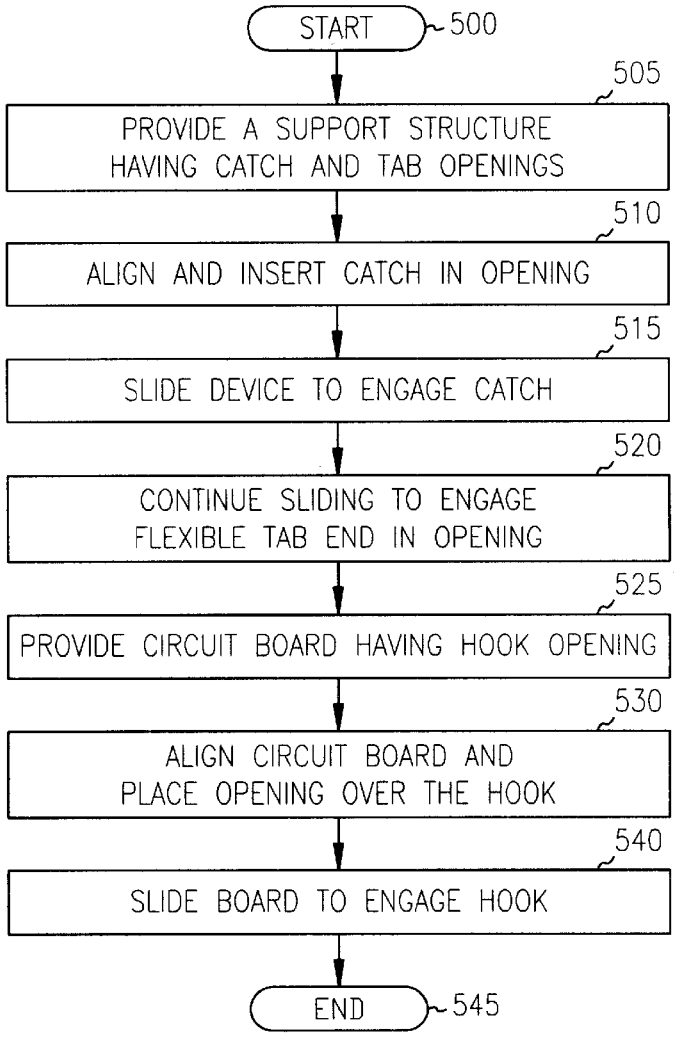
FIG. 7 illustrates a flowchart for the assembly of a mounting system in accordance with one embodiment of the present subject matter.

FIG. 7 illustrates a flowchart for a method of assembly of one embodiment of device 200 in a particular application. At 505, the method calls for providing a support structure having a catch opening and a tab opening. In one embodiment, the openings are depicted in FIG. 3B. At 510, device 200 is positioned in a manner that aligns the catch and tab with the openings of the support structure. The catch of device 200 is inserted in the opening until contact with the planer surface 215 of base 210 is established. Insertion also includes deflection of flexible tab 260 upon contact of end 265 with the support structure. At 515, device 200 is slid in a direction opposite that of flexible tab 260. At 520, continued sliding action results in engagement of the throat of the catch with the edge of the opening in the support structure. The sliding action also causes end 265 to approach, and eventually fall into, one of the openings of the support structure. At 525, the method calls for provision of a circuit board having an opening for hook 245. At 530, the opening of the board is aligned with the hook and the board is placed over the hook. The board is lowered onto device 200 until contact is made with board stop 230 and board stop 235. At 540, the board is slid in a direction to engage the hook on the edge of the opening in the board. Since the direction of the throat on the catch is opposite the direction of the throat on the hook, sliding to engage the hook tends to reinforce the engagement of the catch. In one embodiment, the board is slid a distance of approximately 0.200 inches, which corresponds to the length of the throat of hook 245. At 545, the method of installation is completed.

Figure 8:
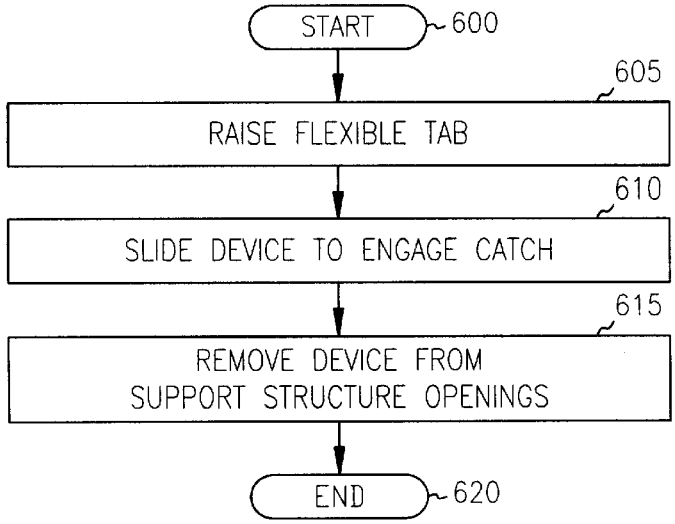
FIG. 8 illustrates a flowchart for the disassembly of a mounting system in accordance with one embodiment of the present subject matter.

FIG. 8 provides a method for disassembly of one embodiment of the present subject matter. At 600, it is assumed that board 125 has been removed from device 200. At 605, end 265 of flexible tab 260 is raised. End 265 can be raised by numerous methods. For example, end 265 can be raised by insertion of a tool or object in the lower side of the opening of the support structure. End 265 can also be raised by prying or lifting flexible tab 260. In one embodiment, a ridge is provided on an edge of end 265 for receiving a lifting tool to facilitate raising of end 265. At 610, the device is slid in a direction to disengage the catch from the edge of the opening in the support structure. At 615, device 200 is raised clear of the openings in the support structure. The method ends at 620.

Device 200 may be fabricated using injection molding, die casting, or other known methods of fabrication. Device 200 may be fabricated from plastic or other insulative material. In one embodiment, device 200 is fabricated of LEXAN® 500 (PC-ABS, 10% glass reinforced). LEXAN is a registered trademark of General Electric Company, 1 River Road Schenectady, Mass. Strength and flexibility requirements of flexible tab 260 may warrant the use of particular materials.

Figure 9B:
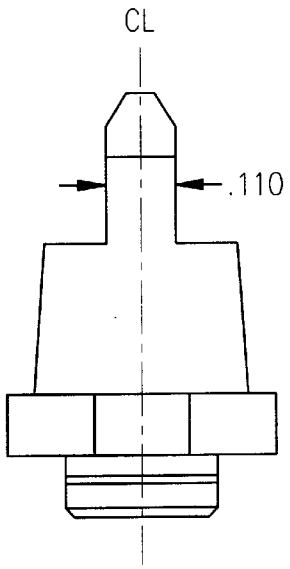
FIGS. 9A, 9B, and 9C (hereinafter collectively referred to as FIG. 9) illustrate dimensions for one embodiment of the present system.
Figure 9A:
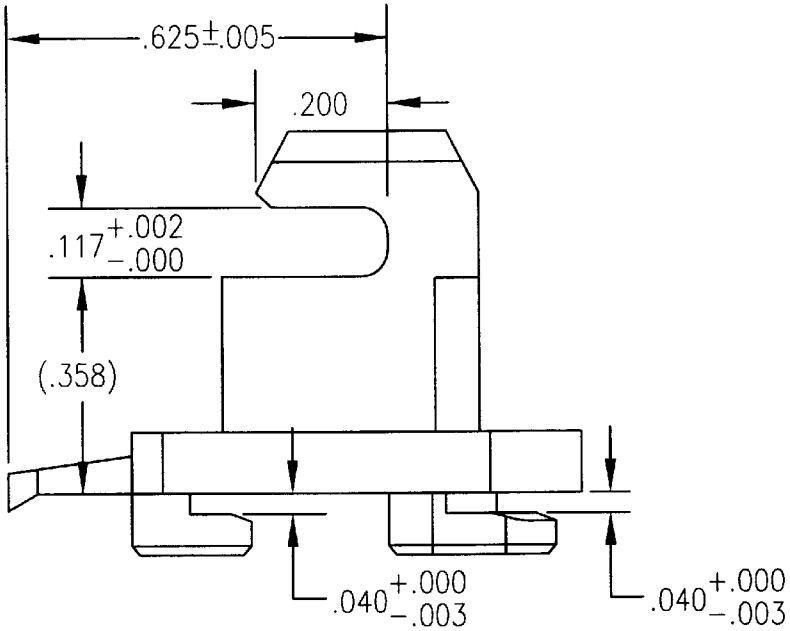
Figure 9C:
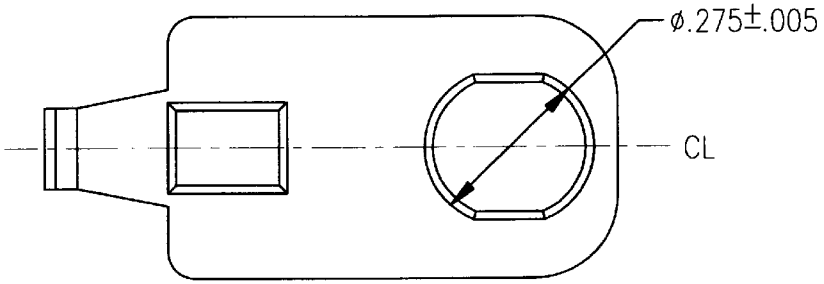

FIG. 9 depicts typical dimensions, in inches, for one embodiment of device 200. The dimensions shown are exemplary only and not to be taken in a limiting sense. The embodiment shown in FIG. 9 includes a fore and aft catch, and a flexible tab for anchoring device 200 in a support structure. As explained herein, the flexible tab holds device 200 immovable during installation and removal of board 125.

CONCLUSION

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention.

What is claimed is:

1. A board mounting device comprising:

a base having a planer surface, the planer surface lying in a plane substantially parallel to the plane of a support structure, the base having a longitudinal axis, the longitudinal axis having a first end and a second end;

a first rigid tab including a first standoff affixed to the base and a first catch affixed to the standoff, the first catch engaging a first edge of the support structure upon movement of the device, relative to the support structure, in a direction towards the first end;

a flexible tab secured to the device, the flexible tab extending towards the second end, the flexible tab having flexibility to allow deflection in a direction normal to the planer surface, the flexible tab having a portion that intersects the plane of the planer surface;

a pedestal affixed normal to the base, the pedestal extending in a direction opposite that of the first rigid tab, the pedestal having a board support surface, the board support surface substantially parallel the plane of the planer surface; and a board hook affixed to the pedestal, the hook engaging a first edge of the board upon movement of the board, relative to the device, in a direction towards the first end.

2. The device of claim 1 wherein the first rigid tab and the flexible tab lie along the longitudinal axis.

3. The device of claim 1 wherein the board includes an electrical connector, the electrical connector adapted to mate with a matching connector upon relative movement of the electrical connector and the matching connector over a distance having a predetermined length, wherein the matching connector is coupled to the support structure, and further wherein the board hook has a slot having a length greater than the predetermined length.

4. The device of claim 1 wherein the board support surface is insulated from the base.

5. The device of claim 1 wherein the device includes insulative material.

6. The device of claim 1 wherein the device is fabricated of insulative material.

7. The device of claim 1 wherein the flexible tab is adapted to resist forces applied in directions lying in the plane of the planer surface.

8. The device of claim 1 further comprising a second rigid tab, the second rigid tab including a second standoff affixed to the base and a second catch affixed to the second standoff, the second catch engaging a second edge of the support structure upon movement of the device, relative to the support structure, in a direction towards the first end.

9. The device of claim 1 wherein the rigid tab standoff and the hook are aligned on an axis normal to the planer surface of the base.

10. The device of claim 8 wherein the second rigid tab lies on the longitudinal axis.

11. A method for mounting a circuit board, the method comprising:

providing a support structure with a first edge and a second edge;

providing a fastener;

engaging the fastener with the first edge of the support structure;

deflecting a flexible tab of the fastener;

engaging the flexible tab of the fastener with the second edge of the support structure;

positioning the circuit board on a portion of the fastener; and displacing the circuit board to engage the fastener.

12. The method of claim 11 wherein providing a support structure with a first edge and a second edge includes providing a support structure with a third edge, the method further comprising engaging the fastener with the third edge of the support structure.

13. The method of claim 11 wherein displacing the circuit board to engage the fastener includes engaging an electrical connector.

14. The method of claim 1 wherein engaging the fastener with the first edge of the support structure includes moving the fastener relative to the support structure in a first linear direction.

15. The method of claim 11 wherein displacing the circuit board to engage the fastener includes moving the circuit board relative to the fastener in a first linear direction.

16. The method of claim 11 wherein engaging the fastener with the first edge of the support structure and displacing the circuit board to engage the fastener includes moving the circuit board in a linear direction relative to the support structure.

17. A device comprising:

a base engagement member adapted to slidably engage a planer surface;

a base locking member adapted to couple with the planer surface and resist disengagement of the base engagement member;

a pedestal member having a first end and a second end, the pedestal member coupled to the base engagement member at a first end and adapted to provide lateral separation between the planer surface and a circuit board;

a board support member disposed at the second end and adapted to couple with the circuit board; and a board catch member disposed at the second end and adapted to slidably engage the circuit board.

18. The device of 17 wherein the base engagement member includes an arm extending in a direction parallel to a plane of the planer surface.

19. The device of 17 wherein the base engagement member includes a first arm extending in a direction parallel to a plane of the planer surface and a second arm extending in a direction parallel to the plane.

20. The device of 17 wherein the base locking member includes a positionable tab.

21. The device of 17 wherein the circuit board includes a first surface and a second surface and wherein the board support member couples to the first surface of the circuit board and wherein the board catch member couples to the second surface of the circuit board.

22. The device of 17 wherein the board support member includes more than one supporting surface.

23. The device of 17 wherein the board catch member includes an extension portion adapted to captivate the circuit board.

* * * * *

UNITED STATES PATENT AND TRADEMARK OFFICE

CERTIFICATE OF CORRECTION

PATENT NO. : 6,428,352 B1
DATED : August 6, 2002
INVENTOR(S) : Franklin Demick Boyden It is certified that error appears in the above-identified patent and that said Letters Patent is hereby corrected as shown below:

Column 8,
Line 40, delete “claim 1” and insert -- claim 11 --, therefor.

Signed and Sealed this

Tenth Day of December, 2002

JAMES E. ROGAN
*Director of the United States Patent and Trademark Office*